United States Patent [19]

Trotta et al.

[11] Patent Number: 4,875,288

[45] **Date of Patent: * Oct. 24, 1989**

[54] SHAVING DEVICE

[75] Inventors: Robert A. Trotta, Pembroke; Jeffrey C. Cerier, Franklin, both of Mass.

[73] Assignee: The Gillette Company, Boston, Mass.

[ * ] Notice: The portion of the term of this patent subsequent to Feb. 28, 2006 has been disclaimed.

[21] Appl. No.: 92,264

[22] Filed: Sep. 2, 1987

[51] Int. Cl.[4] ..... B26B 21/00

[52] U.S. Cl. ..... 30/49; 30/32; 30/50

[58] Field of Search ..... 30/32, 34.2, 49, 346.5, 30/316, 50, 41, 42, 301, 43.6

[56] References Cited

U.S. PATENT DOCUMENTS

| | | | |
|---|---|---|---|
| 1,159,647 | 11/1915 | Bruecker | 30/43.6 |
| 1,973,631 | 9/1934 | Johnson | 30/29.5 |
| 2,223,286 | 11/1940 | Johnson | 30/43.2 |
| 2,279,682 | 4/1942 | Jackson | 30/43.6 |
| 2,359,584 | 10/1944 | Roehner | 30/32 |
| 2,556,208 | 6/1951 | Musso | 30/42 |
| 2,598,711 | 6/1952 | Musso | 30/49 |
| 2,614,321 | 10/1952 | Ackerman | 30/34.2 |
| 2,632,242 | 3/1953 | Musso | 30/49 |
| 2,983,041 | 5/1961 | Kesson | 30/43 |
| 2,989,804 | 6/1961 | Yellon | 30/32 |
| 3,465,436 | 9/1969 | Musso | 30/49 |
| 3,673,684 | 7/1972 | Muntz | 30/34.2 |
| 3,702,026 | 11/1972 | Scholin | 30/49 |
| 4,302,876 | 12/1981 | Emmett | 30/50 X |
| 4,336,651 | 6/1982 | Caro | 30/49 |
| 4,442,598 | 4/1984 | Jacobson | 30/50 X |
| 4,483,068 | 11/1984 | Clifford | 30/49 |
| 4,698,908 | 10/1987 | Bergsma et al. | 30/43.6 |
| 4,711,028 | 12/1987 | Bergsma et al. | 30/43.6 |
| 4,720,917 | 1/1988 | Solow | 30/49 |

FOREIGN PATENT DOCUMENTS

| | | | |
|---|---|---|---|
| 0673449 | 7/1979 | U.S.S.R. | 30/34.2 |

*Primary Examiner*—Eugene R. LaRoche
*Assistant Examiner*—Seung Ham
*Attorney, Agent, or Firm*—Fish & Richardson

[57] ABSTRACT

A tubular upstanding wall of a predetermined height and defining a central aperture has an integrally formed, inwardly facing flange on its upper end, and an integrally formed, outwardly facing flange on its lower end. The inwardly facing flange has a sharpened cutting edge thereby forming a razor blade. One or more razor blades are positioned through apertures in a top member and the outwardly facing flange cooperates with the lower face of the top member to control the vertical position of each razor blade.

35 Claims, 6 Drawing Sheets

SHAVING DEVICE

BACKGROUND OF THE INVENTION

This invention relates to a razor blade, shaving member, razor blade unit, a shaving system and a shaving unit, all including a razor blade having a tubular upstanding wall and defining an annular cutting edge and hereinafter referred to as "units".

More particularly, this invention relates to units which may be resiliently mounted to provide a close, comfortable shave with a high degree of freedom from nicks and cuts, regardless of the shaving technique used.

Wet or dry shaving devices having a single blade or foil formed with multiple cutting edges are known. Typical of such patents are U.S. Pat. Nos. 4,483,068; 2,983,041; 2,989,804; and 2,614,321. Wet or dry shaving systems having one or more blades with an internal cutting edge are likewise known. Typical of such patents are U.S.' Pat. Nos. 4,336,651; 3,702,026; 3,465,436; 2,632,242; 2,598,711; 2,556,208; 2,359,584; 2,279,682; 2,223,286; 1,973,631; and 1,159,647. Such prior art units cannot be resiliently mounted to provide a close, comfortable shaving with the high degree of freedom from nicks and cuts, regardless of the shaving technique used.

SUMMARY OF THE INVENTION

Briefly stated and according to an aspect of this invention, the problems associated with the prior art shavers have been solved by providing a razor blade comprising a generally tubular upstanding wall of a predetermined height and defining a central aperture. An integrally formed, inwardly facing flange which includes a sharpened cutting edge, is formed on an upper end of the tubular upstanding wall, and an integrally formed, outwardly facing flange is formed on a lower end of the wall for mounting the razor blade. One or more razor blades may be positioned through mating apertures in a top member wherein the outwardly facing flange controls the vertical position of the razor blade.

A razor blade unit may be formed by including a blade member of the type described above and including a guard member disposed in the central aperture of the blade member. A guide means may be provided in the central aperture of the blade member for positioning the guard member and for controlling relative motion of the guard member with respect to the blade member.

A preferred razor blade unit may be provided by the practice of this invention in which twin concentric cutting edges are formed by disposing a first razor blade of the above-described type in the central aperture of the first razor blade. A first guide member, including a stop surface, may be included for cooperating with the outwardly facing flange of the concentrically disposed second razor blade, and a second guide member may be included whereby the first and second razor blades are vertically displaceable. If desired, a guard member can also be concentrically disposed in the central aperture of the second concentrically disposed razor blade which itself may be vertically displaceable in response to shaving forces.

A resilient means disposed under one or more of the razor blades may be included for providing dynamic control to the razor blades.

It is an object of this invention to provide a razor blade having a wall and including an inwardly facing flange having a sharpened cutting edge and an outwardly facing flange for mounting the razor blade.

It is another object of this invention to provide a tandem edged or twin blade edge razor blade unit wherein both razor blades have a generally tubular upstanding wall and an inwardly facing flange including a cutting edge and an outwardly facing flange for mounting the razor blade unit.

It is still a further object of this invention to provide a razor blade of the type described above which includes a centrally disposed guard member.

It is still a further object of this invention to provide a wet shaving system made up of a plurality of tubular razor blades which provides efficient rinsing.

It is another object of this invention to provide a wet shaving system which provides a plurality of units which are resiliently mounted to provide a close, comfortable shave with a high degree of freedom from nicks and cuts, regardless of the shaving technique used.

Briefly stated, and according to an aspect of this invention, a plurality of wet shaving units are provided, all of which include at least one razor blade having a generally tubular upstanding wall of a predetermined height and defining a central aperture. An integrally formed, inwardly facing flange is formed on a first end of the razor blade. The inwardly facing flange includes a sharpened cutting edge. An integrally formed, outwardly facing flange is formed on a second end of the razor blade for mounting the razor blade and for controlling the relative vertical movement between each razor blade and a top member.

BRIEF DESCRIPTION OF THE DRAWINGS

The invention, both as to its organization and principles of operation, together with further objects and advantages thereof, may better be understood by referring to the following detailed description of embodiments of the invention taken in conjunction with the accompanying drawings in which.

DETAILED DESCRIPTION

Figure 1:
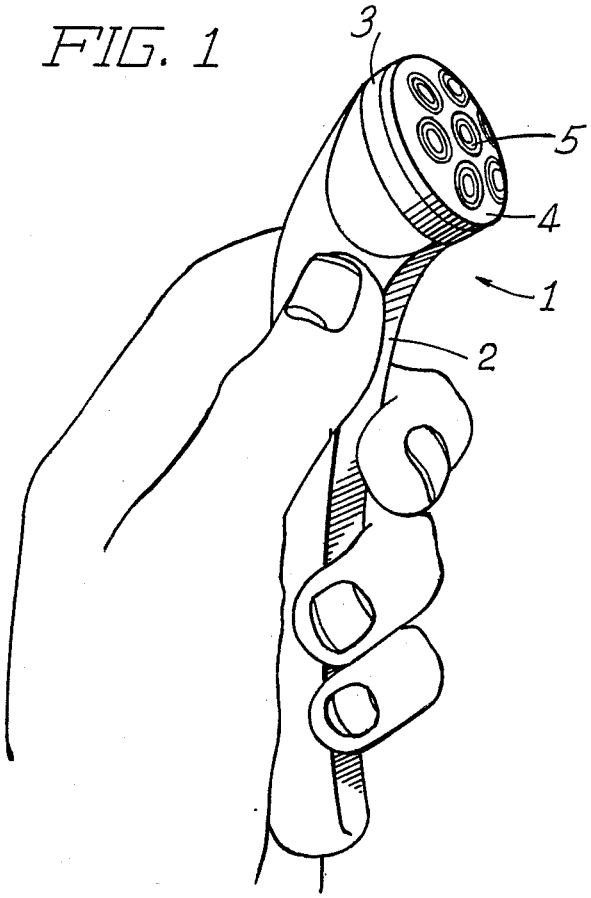
FIG. 1 is a perspective view of a shaving system, in accordance with this invention.

Referring to FIG. 1, a shaving unit 1 is shown in stylized form. The shaving unit 1 is made up of a handle 2 which may include contoured or textured portions to facilitate gripping. The upper portion of the handle 2 is releasably attached to a cartridge 3 by any one of a variety of means well known in the art. Alternatively, the shaving unit 1 may be entirely disposable.

The cartridge 3 is shown to include a generally concaved top member 4 which includes a plurality of apertures through which seven blade units such as blade unit 5 are disposed.

The specific shape of the top member 4 as well as the number and placement and shape of the blade units, such as blade unit 5, may vary widely depending upon design objectives. The shaving unit 1 is preferably designed to be used with well known shaving preparations such as shaving creams or gels. The outer surface of the top member 4 may be smooth or textured as desired.

Preferably, the cartridge 3 of shaving unit 1 is round and is approximately 1.2 inches in diameter and is used for multi-directional shaving. The cartridge 3 preferably consists of seven circular dual blade units, such as blade unit 5. Six of the blade units are arranged concentrically around a seventh centrally located unit. The blade units are resiliently mounted in the top member 4 to provide a close, comfortable shave with a high degree of freedom from nicks and cuts, regardless of the shaving technique used.

Figure 2:
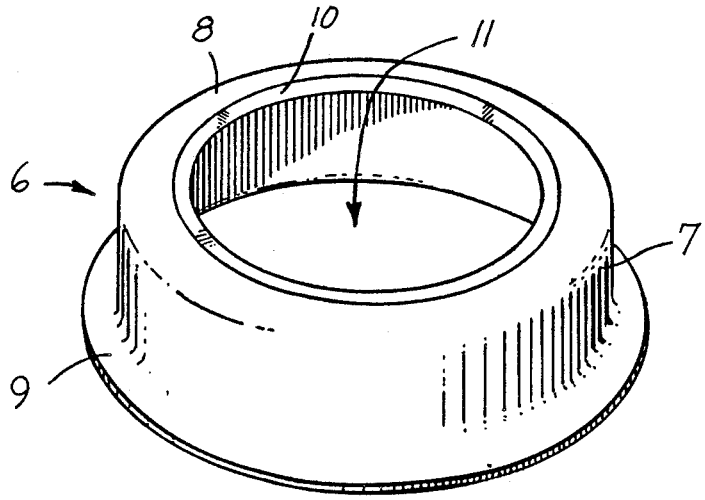
FIG. 2 is a perspective view of a razor blade, in accordance with this invention.

Referring to FIG. 2, a single razor blade 6 is shown. In the dual blade units described subsequently, it will be apparent that they consist of two razor blades 6 of different diameters and concentrically aligned.

The razor blade 6 is designed to be disposed through apertures formed in a top member, such as top member 4, of FIG. 1. Razor blade 6 is generally tubular in shape and includes an upstanding, thin-walled, continuous cylinder portion or wall 7 with an integral inwardly facing flange 8 on an upper end of the wall 7, and an outwardly facing flange 9 on a lower end of the cylindrical wall 7. The inwardly facing flange 8 is sharpened at its edge to produce a blade edge such as circular blade edge 10. The edge 10 on inwardly facing flange 8 may be formed in a variety of manners well known in the art. The edge 10 may be formed in the same or a different plane than the plane parallel to that of the flange 8 or to the face of top member 4 of the shaving unit 1.

The manufacturing of the blade 6 may be accomplished in a variety of well known manners, such as starting with a flat stock razor blade steel, drawing the steel in a cup-like configuration to have an inwardly facing flange 8 and an outwardly facing flange 9, and then grinding and honing or the like to provide the cutting edge 10. It is also contemplated that the blade 6 could be formed starting with a tubular stock material. The outwardly facing flange 9 is used to hold the blade 6 in place when the blade 6 is positioned through an aperture formed in the top member 4 of shaving unit 1. Each tubular razor blade 6 defines a central through-flow aperture 11.

The specific shape of the tubular blade associated with the practice of this invention may vary. That is, the razor blade may not be cylindrical or disk-shaped. May other blade shapes are possible either in the single or tandem blade unit embodiments. Other blade shapes are disclosed in copending application entitled "Shaving Device", Ser. No. 092,021. filed concurrently herewith and owned by the same assignee as is the instant case, the entire disclosure of which is incorporated herein by reference.

Preferably, each razor blade 6 is formed as a thin-walled, stainless steel cylinder to include an integrally, inwardly facing flange on one end and an outwardly facing flange on the other end. The inwardly facing flange 8 is sharpened to produce a continuous blade edge such as a circular blade edge 10. The outwardly facing flange 9 is used to control the vertical position of the razor blade 6.

Figure 3:
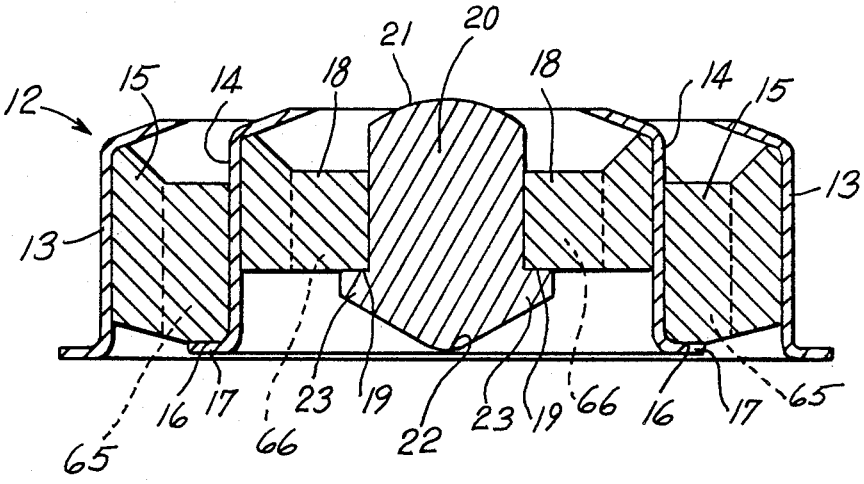
FIG. 3 is a sectional view of a dual razor blade unit, in accordance with this invention.

Referring to FIG. 3, the dual-blade unit 12 comprises an outer tubular blade 13 and an inner tubular blade 14. The blades are preferably formed in the manner described when referring to the razor blade 6 of FIG. 2 and are of different diameters in order to provide concentric alignment of the inner blade unit 14 inside the through-flow aperture of the outer blade unit 13. A generally ring-shaped blade guide 15 is connected to the inside of the outer tubular blade 13 such as by means of a press fit. The first guide means or blade guide 15 is formed of a plastic, such a Delrin, and includes a stop surface 16. The blade guide 15, accordingly in a preferred embodiment, moves with the vertical movement of the outer tubular blade 13.

The stop surface 16 of the blade guide 15 may come into contact with the top surface of outwardly facing flange 17 of inner tubular blade 14 and thereby control relative vertical motion with respect to outer tubular blade 13 and inner tubular blade 14.

Inner tubular blade 14 is concentrically disposed inside the aperture of ring-shaped blade guide 15. Inside the through-flow aperture of inner tubular 14 is a generally ring-shaped second guide member or guard guide 18 connected by a press-fit or the like to the inside of inner tubular blade 14 for movement therewith. The guard guide 18 is likewise preferably formed of a plastic such as Delrin and include a stop surface 19.

Disposed in the aperture of the ring-like guard guide 18 is a concentrically located guard member 20. The guard member 20 is preferably formed as a small molded plastic part, of Delrin, which is located concentrically in the dual blade unit 12. The guard member 20 prevents excessive skin bulge from entering the through-flow aperture of inner tubular blade 14, thus preventing nicks and cuts while allowing hair to be cut.

The guard member 20 includes a central face-engaging portion 21 on an upper end and a generally conical-shaped portion 22 on a lower end of the guard member 20. The conical shaped portion 22 includes a lip portion 23 which may abut the stop surface 19 of guard guide 18 to control relative vertical movement of the inner tubular blade 14 and the guard member 20.

Dual blade unit 12, in a preferred embodiment, thus consists of outer tubular blade 13 and inner tubular blade 14, a concentrically disposed generally cylindrical guard member 20, a first guide means or blade guide 15, and a second guide means or guard guide 18. The dual blade unit 12 is thus comprised of the concentrical alignment of five separate components in a preferred embodiment. In addition, the interaction of the various stop surfaces sets the at-rest geometry of the dual blade unit 12. Preferably, the stop surface 16 on blade guide 15 as well as that portion of the bottom of guard guide 18 which cooperates with stop surface 19 of guard member 20 is discontinuous thereby providing adequate rinsability in the dual-blade unit 12. That is, rinse holes, such as rinse hold 65 in blade guide 15, and rinse hold 66 in guard guide 18 are formed.

Figure 4:
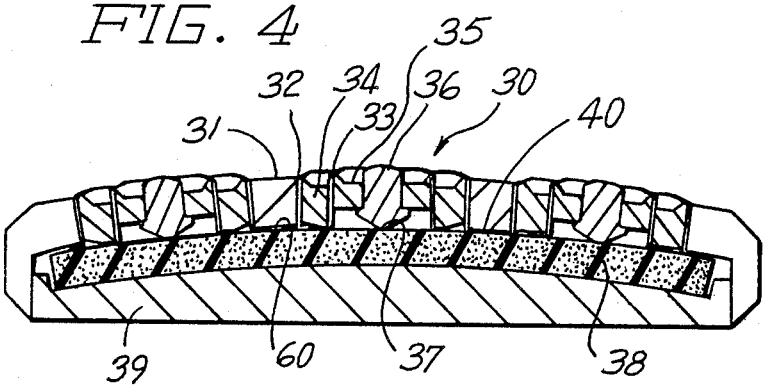
FIG. 4 is a sectional view, showing select detail, of a shaving device, in accordance with this invention.

Referring to FIG. 4, a cartridge section view is shown in which dual-blade units, such as dual-blade unit 30, are captured through apertures in a top member 31. Dual-blade unit 30 includes an outer tubular blade 32, an inner tubular blade 33, a blade guide 34, a guard guide 35, and a guard member 36 having a generally conical portion 37 on the bottom of the guard member 36.

Disposed under the dual-blade unit, such as dual-blade unit 30, is a resilient means, such as an elastomeric spring, suspension, solid rubber, or foam member 38. For convenience of illustration, foam member 38 is shown as including no rinse holes or the like. A base member 39, better viewed when referring to FIG. 9, traps the foam member 38 in place.

The at-rest position of each dual-blade unit, such as dual-blade unit 30, is set by contact of the underside, such as stop surface 60, of the top member 31 with the top of the outwardly facing flange of the outer blade of each unit, such as outwardly facing flange 40 of outer tubular blade 32.

Figure 5:
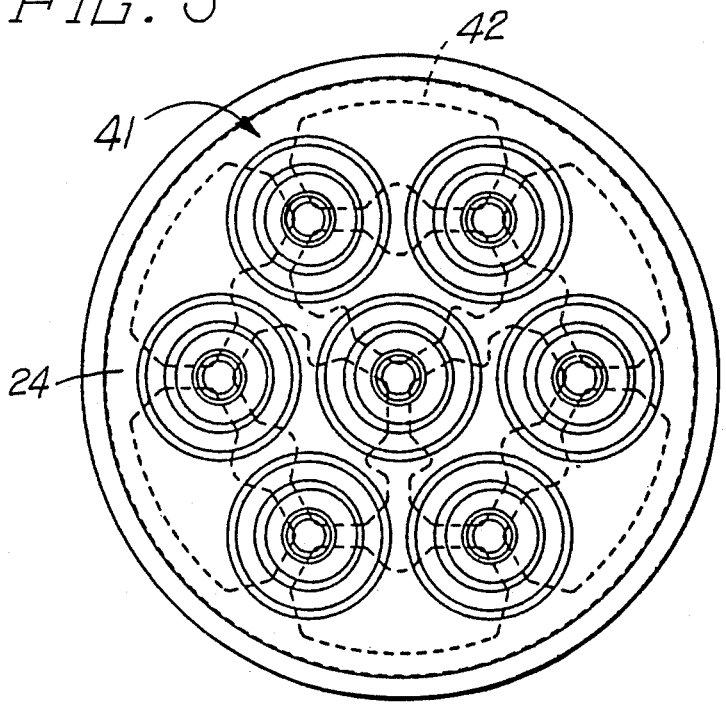
FIG. 5 is a top view of the shaving device of FIG. 4, in accordance with this invention.

Referring now to FIG. 5, a top view of top member 24 as illustrated with seven dual blade units, such as dual blade unit 41. Formed in dashed lines is a resilient means or foam member 42.

Figure 8:
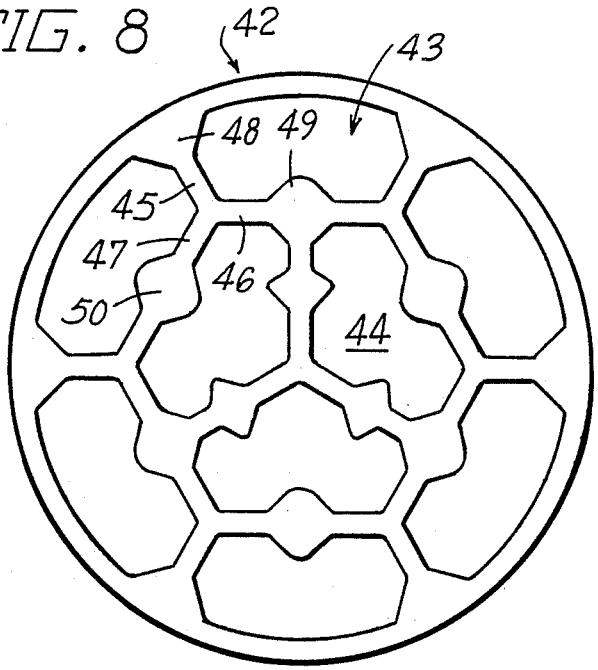
FIG. 8 is a top view of a resilient means, in accordance with this invention.

Foam member 42 can best be seen in FIG. 8. Foam member 42 is preferably formed in one piece out of a material such as cellular urethane and has a thickness such as approximately 0.060 inch. The foam member 42 includes a plurality of rinse holes such as rinse holes 43 and 44. The function of the foam member 42 is to provide the dynamic control of all seven dual blade units. Each blade unit is positioned centrally over a portion of the suspension having three sections extending radially, spaced 120° apart, such as portions 45, 46, and 47, which support a dual blade unit, such as dual blade unit 41, best seen in FIG. 5. The foam is so shaped such that each section has a larger surface area, such as surface areas 48, 49, and 50 to provide contact areas of foam.

Utilizing three portions, such as portions or sections 45, 46, and 47 for dual-blade unit 41, provides the best combination of even forced distribution and rinsability. A small pre-load is exerted on the outer blade flanges of each single or dual blade unit associated therewith by way of a slight pre-compression of the foam member 42. When shaving, the face exerts forces on the blade edges which are transferred to the foam by the blade flanges. The inner and outer blades contact areas of foam, which are in direct proportion to the linear blade edge for each. By designing the foam in this way, the forces of the face on the blades per linear blade edge has been kept equal for the inner and outer blades.

The conical shape, such as conical portion 37 of guard member 36, best seen in FIG. 4 on the bottom of guard member 36, in combination with the resilient means such as foam member 38 upon which the tip of the conical portion 37 of guard member 36 may rest, provides progressive spring rates increasing the safety of the razor in use. As more force is exerted on the guard member 36 by the face, the conical portion 37 is pushed further into the foam member 38, which will offer progressively more resistance. This is contrast to the linear spring rates for the inner and outer tubular blades of the dual-blade unit. The foam suspension is preferably designed for the following approximate forces: total deflection—0.40 inch; outer blade—37 g; inner blade—20 g; and guard—10 g.

Figure 6:
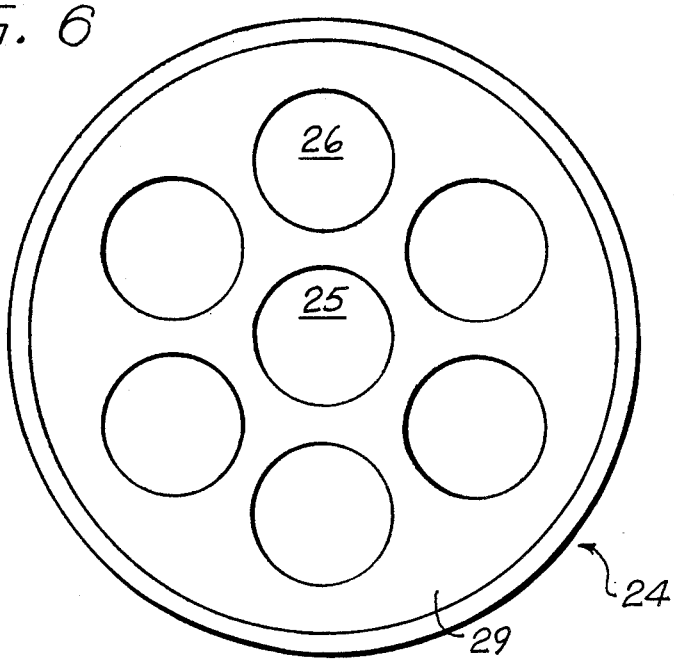
FIG. 6 is a top view of a top member, in accordance with this invention.
Figure 7:
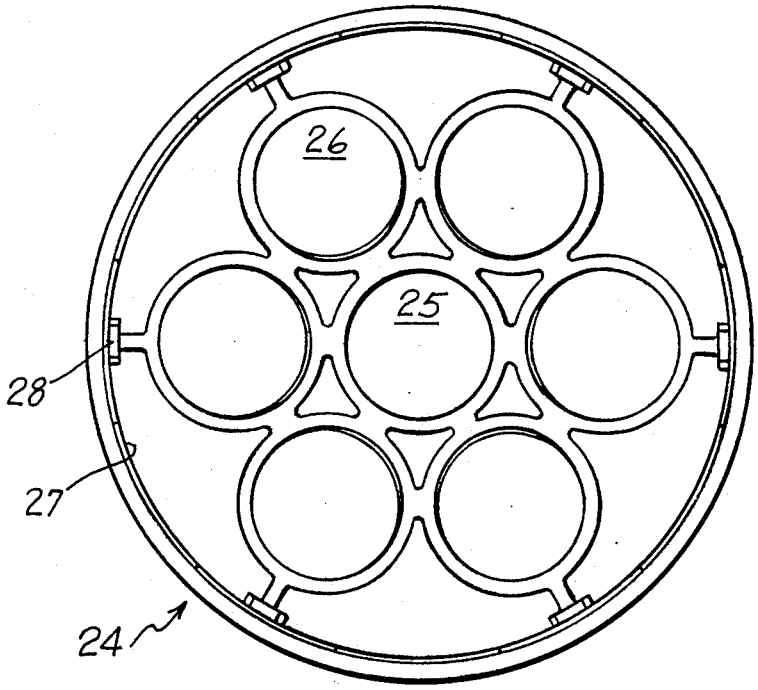
FIG. 7 is a bottom view of the top member of FIG. 6, in accordance with this invention.

Referring to FIGS. 6 and 7, the top member 24 is illustrated as being generally cylindrical and including seven apertures or holes. A central aperture 25 is formed in the middle of the top member 24. Six like holes, such as hole 26, having a diameter such as about 0.27 inch, are arranged concentrically around hole 25 at approximately every 60° from the center of the top member 24. The top member 24 is preferably integrally molded from a plastic such as Delrin and has thickness of approximately 0.073 inch. The surface of outer face 29 of top member 24 may be polished, textured, or the like.

The face surface 29 of the top member 24 has a spherical radius of approximately 2.95 inches which has been determined to be optimum in a circular cartridge of an appropriate diameter of 1.20 inches. The cartridge includes seven dual-blade units.

Best seen in FIG. 7, six keys, such as key 28, are integrally formed on the bottom of top member 24. Each key is aligned with respect to keyways, such as keyway 70, integrally formed on base member 51, best seen in FIG. 9, to provide relative radial alignment between the top member 24 and the base member 51 with the form member 42 of FIG. 8 trapped between. Detents, such as detent 52 on base member 51, cooperate with slots, such as slot 27 of top member 24 to provide a secure mating of the top member 24 to the base member 51.

Figure 9:
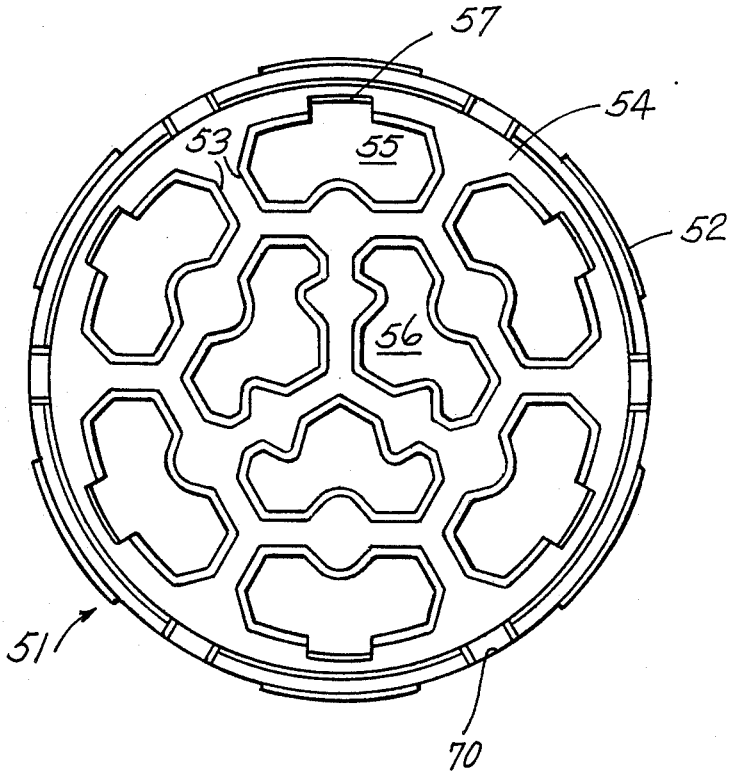
FIG. 9 is a top view of a base member, in accordance with this invention.

As best seen in FIG. 9, a plurality of handle attachment detents, such as detent 57, are provided on the base member 51 for coupling with a handle. The handle attachment may be formed as a releasable coupling to the formed cartridge in order to form a razor system having a replaceable cartridge.

The base member 51 of FIG. 9 is preferably a molded plastic part made of polystyrene. The base member 51 also positions and aligns the foam member 42 by having a similarly shaped platform portion including a plurality of upstanding ridges, such as ridges 53. The foam member 42 is positioned on the platform 54 between ridges such as ridges 53 which are of a height less than the thickness of the foam member 42. The solid ridges thereby set the deflection limits of the blades. Disposed through the platform 54 of the base member 51 are a plurality of rinse holes, such as rinse hole 55, which align generally under rinse hole 43 of foam member 42, and rinse hold 56 which aligns generally under rinse hole 44 of foam member 42.

Figure 10:
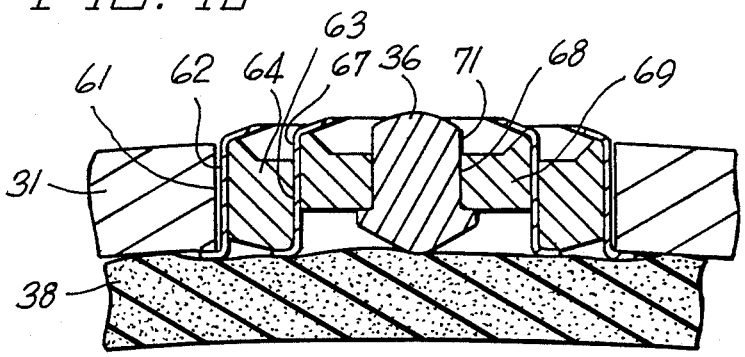
FIG. 10 is a sectional view of a dual blade unit's dynamics in its at-rest position, in accordance with this invention.
Figure 11:
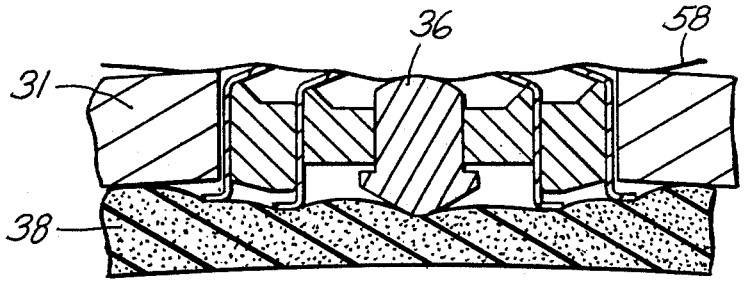
FIG. 11 is a sectional view of a dual blade unit's dynamics in the presence of low shaving forces, in accordance with this invention.

Referring now to FIG. 10, it is important to note that the shaving system defined herein was designed to give close, comfortable shaves without a high degree of nicks and cuts, regardless of the shaving techniques used. This is accomplished by carefully controlling the relative motions of the shaving components, i.e. the blades and guards. The factors which determine the closeness and safety of the shaving unit can be divided into two categories, i.e. the internal dual-blade unit geometries and the heights of the dual-blade units in the head of cartridge of the razor. With the cartridge at rest, such as shown in FIG. 10, the internal dual-blade unit geometry is at its safest position, while the height of the unit in the head is at its most aggressive position. As shown in FIG. 11, shaving commences, and force is exerted by the skin surface 58 on the shaving elements, the skin bulge produced causes the internal geometries to become more aggressive while the height in the head becomes less aggressive.

Figure 12:
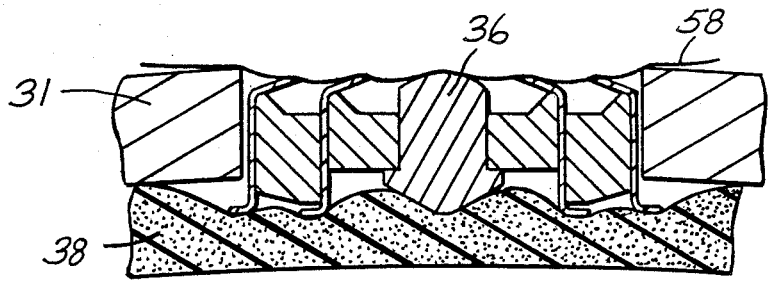
FIG. 12 is a sectional view of a dual blade unit's dynamics in the presence of high shaving forces, in accordance with this invention.

Referring to FIG. 12, for maximum shaving forces, the internal geometries increase in safety once again, due to the progressive spring rate of the guard member 36, discussed earlier, and the bottoming out of the outwardly facing flanges of the blade members on the ridges, such as ridges 53, described when referring to FIG. 9. Thus, at high forces, safety is maximized.

Referring to FIG. 10, relative motion is provided between aperture wall 61 of top member 31 and the outer wall surface 62 of the outer blade; between wall 63 or blade guide 64 and outer wall surface 67 of the inner blade; and between wall 68 of guard guide 69 and the outer wall surface 71 of guard member 36. The clearance between these bearing surfaces must be adequate to allow the desired relative motions.

The diameter of each hole, such as hole 26 of FIG. 6, is such that the outer tubular member, in the case of a dual-blade unit, or a single tubular razor blade can retract into the cartridge smoothly during shaving, without allowing excessive lateral movement or the possibility of jamming. Thus, each of the blade units are captured in the cartridge but permit relative motion with respect thereto.

While embodiments and applications of the invention have been shown and described, it will be apparent to those skilled in the art that many more modifications are possible without departing from the invention concepts herein described. For example, the guard member may be also molded entirely, or in part, through a technique such as two-color molding to including a water-leachable material, such as polyethylene oxide, well known in the art. The invention, therefore, is not to be restricted except as is necessary by the prior art and by the spirit of the appended claims.

What is claimed as new and desired to be secured by Letters Patent of the United States is:

1. A shaving system of the wet shave type comprising:

a plurality of razor blades, each of said razor blades having a generally tubular upstanding wall of a predetermined height and defining a central aperture, said wall having an upper and lower end, each of said razor blades having an integrally formed, inwardly facing flange on said upper end, the inner edge of each of said inwardly facing flanges having an annular sharpened cutting edge, each of said razor blades having integral outwardly facing flange structure for controlling the vertical position of each of said razor blades; and a top member having an upper and lower face and having a thickness less than the height of said upstanding wall of each of said razor blades, said top member including an array of spaced apertures, each said aperture having a shape generally corresponding to the outer surface of said tubular upstanding wall of a razor blade, one of said razor blades disposed in each of said apertures of said top member for vertical movement relative thereto, said top member including surface structure that cooperates with said integral outwardly facing flange structure of each of said razor blades to control relative vertical movement between each of said razor blades and said top member in response to shaving forces.

2. A shaving member as in claim 1 wherein each said upstanding wall is formed as a thin-walled cylinder having a thickness of approximately 4/1000ths inch.

3. The shaving member as in claim 1 wherein each said thin-walled cylinder is comprised of stainless steel.

4. The shaving member as in claim 1 wherein said top member is generally circular in shape and six of said razor blades are concentrically disposed around a centrally located razor blade in said top member.

5. The shaving member as in claim 4 wherein the diameter of said circular top member is approximately 1.2 inches.

6. The shaving member as in claim 1 wherein said top member has a spherical radius of approximately 2.95 inches.

7. A razor blade system of the wet shave type comprising:

a support member;

a blade member carried on said support member, said blade member having a tubular upstanding wall of predetermined height, said blade member defining a central aperture, said wall having an upper and lower end, an inwardly facing flange formed on said upper end and an annular sharpened cutting edge formed in said inwardly facing flange, and integral outwardly facing flange structure on said wall;

a guard member disposed in the central aperture of said blade member for movement relative to said support member; and guide means positioned between said upstanding wall and said guard member for positioning said guard member relative to said blade member while permitting relative motion between said guard member and said blade member.

8. The razor blade unit as in claim 7 wherein said guide means includes a generally tubular guide member having a central aperture, said guard member being positioned in said central aperture of said guide member.

9. The razor blade unit as in claim 8 wherein said guard member includes a column portion disposed in said aperture of said guide member.

10. The razor blade unit as in claim 9 wherein said guard member further includes stop structure that limits relative motion between said guard member and said guide member in a direction toward said cutting edge of said blade member.

11. The razor blade unit as in claim 10 wherein said guide means includes a stop surface cooperating with said stop structure of said guard member to control relative vertical movement between said blade member and said guard member.

12. The razor blade unit as in claim 7 wherein said guide member is pressed fit into said blade member.

13. A razor blade unit comprising:

a first razor blade having an upstanding wall of a predetermined height and defining a central aperture, said wall having an upper and lower end, said first razor blade also including an inwardly facing flange on said upper end, said inwardly facing flange having a sharpened cutting edge, and said first razor blade including integral outwardly facing flange structure on said wall;

a second razor blade having an upstanding wall of predetermined height and defining a central aperture, said wall having an upper and lower end, said second razor blade also including an inwardly facing flange on said upper end, said inwardly facing flange having a sharpened cutting edge, and said second razor blade including integral outwardly facing flange structure on said wall, said second razor blade being concentrically disposed in the central aperture of said first razor blade;

a first guide member disposed in said central aperture of said first razor blade and connected to said first razor blade, said first guide member including a stop surface for cooperating with said integral outwardly facing flange structure of said second razor blade; and a second guide member disposed within said central aperture of said second razor blade and connected to said second razor blade unit, said first razor blade and said second razor blade being vertically displaceable.

14. The razor blade unit as in claim 13 wherein said second guide means includes a stop surface, and further including a guard member concentrically disposed in said central aperture of said second razor blade and having a stop portion, said stop surface of said guard second guide membercooperating with said stop portion of said guard member, said first razor blade, said second razor blade, and said guard member are vertically displaceable relative to one another in response to shaving forces.

15. The razor blade unit as in claim 14 wherein said first and second razor blades are generally tubular in shape.

16. The razor blade unit as in claim 13 further including a top member having an aperture disposed about said first razor blade and cooperating with said integral outwardly facing flange structure of said first razor blade for controlling the vertical displacement of said first razor blade relative to said top member.

17. A razor blade unit comprising:

a first razor blade having a generally tubular upstanding wall of a predetermined height and defining a central aperture, said wall having an upper and lower end, said first razor blade also including an integrally formed, inwardly facing flange on said upper end, said inwardly facing flange having a sharpened cutting edge, and said first razor blade including an integrally formed, outwardly facing flange on said lower end;

A second razor blade having a generally tubular upstanding wall of predetermined height and defining a central aperture, said wall having an upper and lower end, said second razor blade also including an integrally formed, inwardly facing flange on said upper end, said inwardly facing flange having a sharpened cutting edge, and said second razor blade including an integrally formed outwardly facing flange on said lower end, said second razor blade being concentrically disposed in the central aperture of said first razor blade;

a first guide member disposed in said central aperture of said first razor blade and connected to said first razor blade, said first guide member including a stop surface for cooperating with said outwardly facing flange of said second razor blade;

a second guide member disposed within said central aperture of said second razor blade and connected to said second razor blade unit, said second guide member also including a stop surface; and a guard member concentrically disposed in said central aperture of said second razor blade and including a stop portion, said bearing surface of said second guide member cooperating with said stop portion of said guard member, whereby said first razor blade, said second razor blade, and said guard member are vertically displaceable in response to shaving forces.

18. The razor blade unit as in claim 17 wherein said guard member includes a column portion, said column portion being disposed through said central aperture of said second guide member.

19. The razor blade unit as in claim 18 wherein said stop member prevents relative motion between said guard member and said second guide member in a direction toward said cutting edge of said first and second razor blades.

20. A razor blade unit as in claim 19 wherein said first guide member is pressed fit into said first razor blade and said second guide member is pressed fit into said second razor blade.

21. The razor blade unit as in claim 20 wherein said column portion of said guard member includes a shave-facilitating agent.

22. The razor blade as in claim 21 wherein said shave-facilitating agent is a water-soluble lubricant.

23. A shaving system comprising:

a plurality of razor blades, each of said razor blades having a generally tubular upstanding wall of a predetermined height and defining a central aperture, said wall having upper and lower ends, each of said razor blades having an inwardly facing flange with an annular cutting edge on said upper end and an outwardly facing flange on said lower end;

a top member having a plurality of spaced apertures, said plurality of said razor blades being disposed in corresponding ones of said apertures of said top member, said top member including stop surface structure for cooperating with said outwardly facing flanges of said razor blades to control vertical movement of said blades relative to said top member in response to shaving forces; and resilient means disposed under said razor blades for biasing said outwardly facing flanges of said razor blades toward said stop surface structure.

24. The shaving system as in claim 23 wherein said resilient means is a foam member.

25. The shaving system as in claim 23 further including a base member disposed under said resilient means for mounting said resilient means to said top member.

26. The shaving system as in claim 25 wherein said base member includes means for orienting said resilient means.

27. The shaving system as in claim 25 wherein said base member includes a plurality of rinse holes.

28. The shaving system as in claim 26 wherein said orienting means of said base member provides predetermined deflection limits of said blades.

29. The shaving system as in claim 24 wherein said foam member provides a small pre-load on said outwardly facing flanges of said razor blades.

30. The shaving system as in claim 25 wherein said base member includes means for providing attachment to a handle.

31. The shaving system as in claim 23 and further including a guard member in said central aperture of each of said razor blades.

32. The shaving system as in claim 31 wherein each of said guard members includes a bottom conical shape to provide progressive spring rates in cooperation with said resilient means in response to increase of shaving force on said razor blades.

33. A shaving unit comprising:

a plurality of first razor blades, each having a generally tubular upstanding wall of a predetermined height and defining a central aperture, said wall having an upper and lower end, each of said first razor blade also including an integrally formed, inwardly facing flange on said upper end, said inwardly facing flange having a sharpened cutting edge, and each of said first razor blade including an integrally formed, outwardly facing flange on said lower end;

a plurality of second razor blades, each having a generally tubular upstanding wall of predetermined height and defining a central aperture, said wall having an upper and lower end, each of said second razor blade also including an integrally formed, inwardly facing flange on said upper end, said inwardly facing flange having a sharpened cutting edge, and each of said second razor blade including an integrally formed outwardly facing flange on said lower end, each of said second razor blade being respectively concentrically disposed in the central aperture of said each of first razor blades;

a plurality of first guide members disposed in said respective central apertures of said first razor blades and connected to said respective first razor blades, each of said first guide members including a stop surface for cooperating with said outwardly facing flanges of said second razor blades;

a plurality of second guide members disposed in said respective central apertures of said second razor blades and connected to said respective second razor blade units, each of said second guide members also including a stop surface;

a plurality of guard members concentrically disposed in said respective central aperture of each of said second razor blades also including a stop portion, said stop surface of each of said second guide members cooperating with said respective stop portions of said guard members, whereby each of said first razor blade, said second razor blade, and said guard member are respectively vertically displaceable in response to shaving forces;

a top member having an upper and lower face and having a thickness less than the height of said upstanding wall of each of said first razor blades, said top member including a plurality of apertures having a generally tubular shape, each of said apertures of said top member being disposed about said respective wall of each of said first razor blades whereby said lower face of said top member includes a stop surface for cooperating with said outwardly facing flange of each of said first razor blades to control relative vertical movement between each of said first razor blades and said top member;

resilient means disposed under each of said first and second razor blades for providing dynamic control to said first and second razor blades; and a base member disposed under said resilient means for mounting said resilient means to said top member.

34. The shaving unit as in claim 33 wherein said resilient means includes a foam pad member.

35. The shaving unit as in claim 34 wherein said foam pad is integrally formed and includes three sections extending radially, and spaced approximately 120° apart, said each of said first and second razor blades being positioned over said three sections.

* * * * *

UNITED STATES PATENT AND TRADEMARK OFFICE

CERTIFICATE OF CORRECTION

PATENT NO. : 4,875,288

DATED : October 24, 1989

INVENTOR(S) : Robert A. Trotta, et al

It is certified that error appears in the above-identified patent and that said Letters Patent is hereby corrected as shown below:

Col. 3, line 65, "May" should be --Many--.

Col. 4, line 39, "include" should be --includes--.

Col. 5, line 1, "hold" should be --hole-- (both occurrences).

Col. 6, line 48, "hold" should be --hole--.

Col. 7, line 11, "or" should be --of--.

Col. 9, line 20, claim 14, "membercooperating" should be --member cooperating--.

Col. 9, line 44, claim 17, "A" should be --a--.

Col. 10, line 13, claim 20, "A" should be --The--.

Col. 12, line 29, claim 34, after "pad" delete --member--.

Signed and Sealed this

Fifteenth Day of January, 1991

*Attest:*

HARRY F. MANBECK, JR.

*Attesting Officer*

*Commissioner of Patents and Trademarks*